US011479972B1

(12) United States Patent
Gregorwich

(10) Patent No.: US 11,479,972 B1
(45) Date of Patent: Oct. 25, 2022

(54) SAFETY CAP

(71) Applicant: Joseph W. Gregorwich, Costa Mesa, CA (US)

(72) Inventor: Joseph W. Gregorwich, Costa Mesa, CA (US)

( * ) Notice: Subject to any disclaimer, the term of this patent is extended or adjusted under 35 U.S.C. 154(b) by 0 days.

(21) Appl. No.: 17/334,728

(22) Filed: May 29, 2021

(51) Int. Cl.
*E04C 5/16* (2006.01)
*E04G 21/32* (2006.01)

(52) U.S. Cl.
CPC ..... *E04C 5/161* (2013.01); *E04G 21/3252* (2013.01)

(58) Field of Classification Search
CPC ..... E04C 5/161; E04G 21/3252
See application file for complete search history.

(56) References Cited

U.S. PATENT DOCUMENTS 5,313,757 A * 5/1994 Schnepf ..... E04C 5/161 52/301
10,822,799 B2 * 11/2020 Ryan ..... E04G 21/32
2002/0116887 A1 * 8/2002 Niday ..... E04C 5/161 52/318
2009/0107067 A1 * 4/2009 Beery ..... F16P 1/00 52/301
2009/0313927 A1 * 12/2009 Myers, Jr. ..... E04G 21/3252 52/301
2012/0291381 A1 * 11/2012 Kassarjian ..... E04G 21/3252 52/301

FOREIGN PATENT DOCUMENTS

FR 0347326 A1 * 12/1989
JP 2617423 B2 * 6/1997
WO WO-2010000038 A1 * 1/2010 ..... E04C 5/161

* cited by examiner

*Primary Examiner* — Adriana Figueroa
(74) *Attorney, Agent, or Firm* — The Law Office of Austin Bonderer, PC; Austin Bonderer

(57) ABSTRACT

A safety cap is to be used on linear members to provide a greater surface area on the end of the linear members. The cap has a platform and an attachment portion that is coupled to the platform. The attachment portion has two or more engagement members and two or more joint portions. Each joint portion couples two of the two or more engagement members together, and the two or more engagement members extend inward from the two or more joint portions.

20 Claims, 9 Drawing Sheets

SAFETY CAP

FIELD

The subject matter herein generally relates to covers for reinforcing steel bars, also known as "rebar." While disclosed in relation to rebar, the invention is not limited thereto.

BACKGROUND

Worksites often, during construction, leave linear members, such as rebar and other items, exposed. These exposed linear members present a hazard such that individuals can impale themselves if one were to fall, step, or land on the exposed linear members. As means to mitigate the danger presented, caps, often referred to as "rebar caps," have been used to cover the exposed end. The caps increase the effective surface area of the exposed end in hopes of preventing injury.

Traditional caps have a platform and an engagement section that extends over the rebar. Typically the engagement section has fins (as seen in FIG. 14, 131) extending inwards to engage the rebar. Given repetitive use and/or use on differing diameter rebar, the structural integrity of the fins tend to fail after several uses, resulting in a flimsy connection to the rebar and thereby allowing the cap to be easily displaced. Once a cap is unintentionally removed the safety of workers and the public is at risk and liability exposure increases.

BRIEF DESCRIPTION OF THE DRAWINGS

Implementations of the present technology will now be described, by way of example only, with reference to the attached figures, wherein.

DETAILED DESCRIPTION

Figure 1:
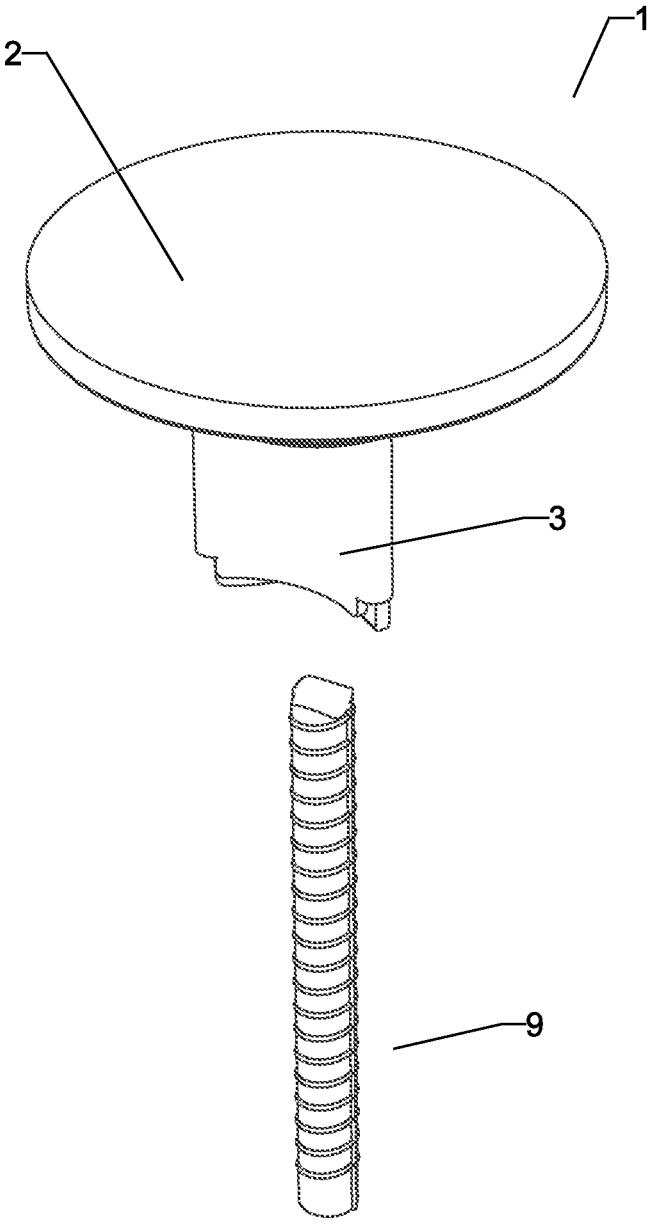
FIG. 1 shows an embodiment of a cap and a linear member.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale, and the proportions of certain parts may be exaggerated to better illustrate details and features. The description is not to be considered as limiting the scope of the embodiments described herein. It should be noted that references to "an" or "one" embodiment in this disclosure are not necessarily to the same embodiment, and such references mean at least one.

Several definitions that apply throughout this disclosure will now be presented.

The term "coupled" is defined as connected, whether integral with, directly attached, or indirectly attached through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape, or other word that substantially modifies, such that the component need not be exact. For example, substantially cylindrical means that the object resembles a cylinder but can have one or more deviations from a true cylinder. The term "comprising" means "including, but not necessarily limited to"; it specifically indicates open-ended inclusion or membership in a so-described combination, group, series, and the like.

The present disclosure is described in relation to a cap for rebar; however, the cap can be used on any number of items.

FIG. 1 illustrates an embodiment of a cap 1. The cap 1 comprises a platform 2 and the attachment portion 3, and the attachment portion 3 is placed over the linear member 9.

Figure 2:
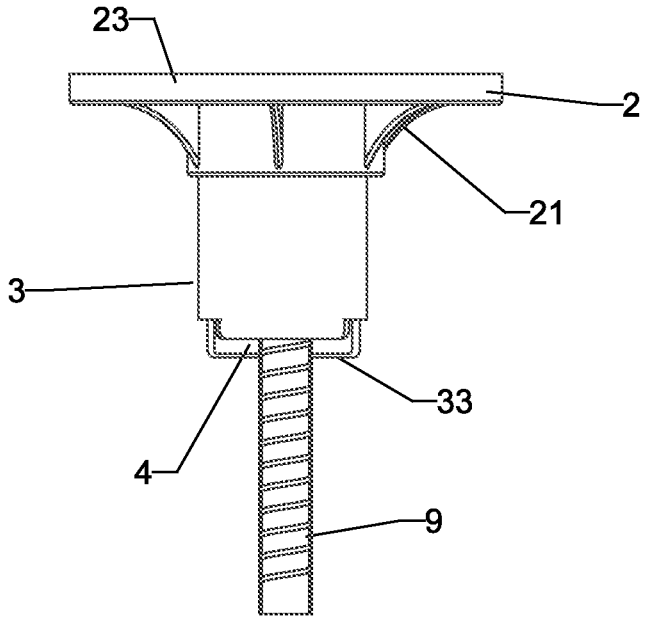
FIG. 2 shows an embodiment of a cap coupled to a linear member.

FIG. 2 illustrates an embodiment of a cap 1 with a linear member 9 inserted therein.

In some embodiments, the platform 2 comprises a deck 23. While the deck 23 is shown as a circular shape, it is understood that the deck 23 can be of any shape (e.g. square). In some embodiments the deck 23 defines a plane, and in some other embodiments, the deck 23 defines three-dimensional structure.

In some embodiments, the platform 2 comprises a support 22. In some embodiments, the support 22 is coupled to the deck 23. In some embodiments, the support 22 is coupled to the deck 23, at least in part, by one or more structural members 21. The structural members 21 can help distribute the force from the deck 23 to the support 22 if force was applied to the deck 23, to help maintain as much of the effective surface area as possible and prevent severe injury. In some embodiments, the structural members 21 can extend from support 22 out towards the periphery of the deck 23. In some embodiments, the structural members 21 extend from the support 22 to the periphery of the deck 23. The number and size of the structural members 21 are not limited.

Figure 3:
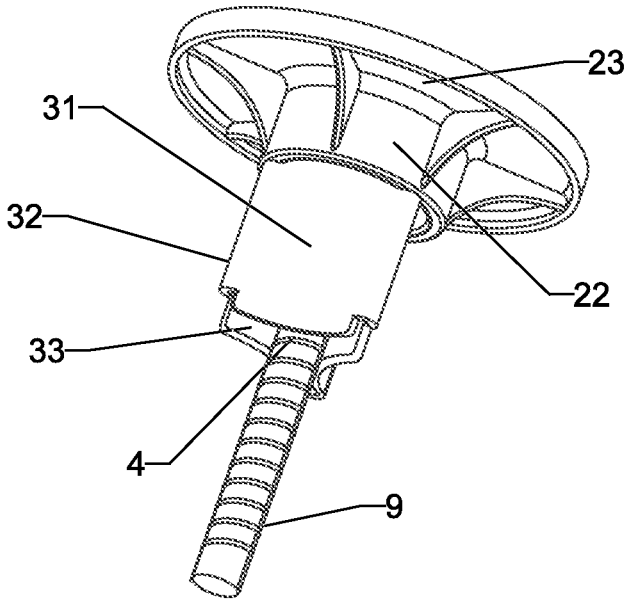
FIG. 3 shows an embodiment of a cap coupled to a linear member.

FIG. 3 illustrates an embodiment of a cap 1 comprising an embodiment of the attachment portion 3. The attachment portion 3 is coupled to the platform 2. In some embodiments, the attachment portion 3 is coupled to the platform 2 via the support 22. In some embodiments, the attachment portion 3 comprises three or more engagement members 31 and three or more joint portions 32. As can be seen in FIGS. 1-13, the engagement members 31 extend from one joint portion 32 to another joint portion 32. Each engagement member 31 comprises an engagement member body and two ends, and at least a portion of each end is coupled to a joint portion 32. The engagement members 31 extend down from the platform 2 and engage the sides of the linear member 9. In some embodiments, the engagement members 31 define a concave, or substantially concave, shape, and each joint portion 32 couples two engagement members 31.

In some embodiments, one or more of the engagement members 31 are longer than the other engagement members 31, thereby creating an extension 33. The extension 33 can facilitate the use of the cap 1. The user is able to press the linear member 9 against the extension 33, and then insert the linear member 9 into the engagement space 4. In some embodiments, when pressing against the extension 33, the linear member 9 will deflect one or more engagement members 31 and increase the size of the engagement space 4. The user can use as much force as necessary depending on the width of the linear member 9 and the cap 1. In some embodiments, the engagement members 31 are biased towards each other, and when the linear member 9 is inserted in the engagement space 4 (that is at least partially defined by engagement members 31), they are able to apply force to, and at least partially secure, the linear member 9 in the engagement space 4. In some embodiments, once inserted in the engagement space 4, the linear member 9 can be inserted until it abuts the platform 2.

Figure 4A:
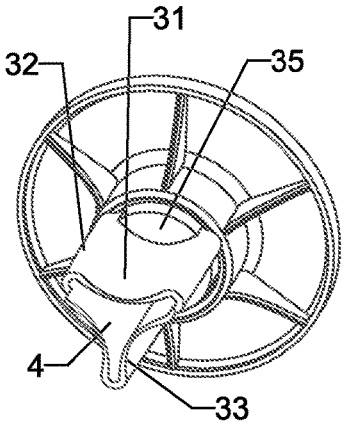
FIGS. 4A, 4B, and 4C show embodiments of a cap having differing shaped engagement members.
Figure 4B:
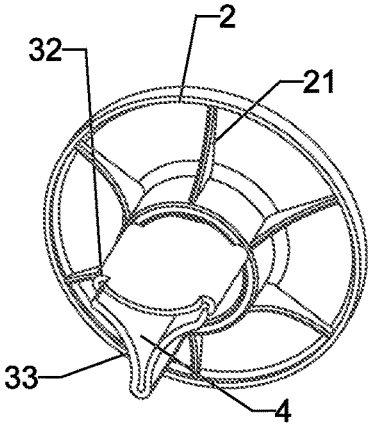
Figure 4C:
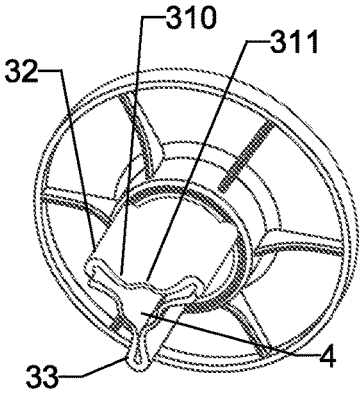

In FIGS. 4A-4C, several options for embodiments of the caps 1 are shown. As can be seen, differing shapes of the engagement members 31. FIGS. 4*a* and 4*b*, show the engagement members 31 as a complete concave arc. The arc length and degree can be altered as desired. In some embodiments, the engagement members 31 comprise a first section 310 and second section 311. In some embodiments, the second section 311 is convex or substantially convex. In some embodiments, the thickness of the engagement members 31 can vary along its length. In some embodiments, the second sections 311 can increase the effective size of the engagement space 4.

Also shown in FIG. 4A, some embodiments comprise one or more biasing members 35 that bias the engagement members 31 toward the resting position. In some embodiments, the biasing member 35 is located adjacent to the support 22. In some embodiments, the biasing member 35 comprises an elastic material. In some embodiments, the biasing member 35 will help the engagement member 31 apply force, directly or indirectly, to the linear member 9. In some embodiments, the biasing member 35 comprises a shape that fully, or at least partially, corresponds to the exterior shape of the corresponding engagement member 31 in the resting position. In some embodiments, the biasing member 35 has a shape that fully or at least partially corresponds to an engagement member 31 comprising a second section 311. In some embodiments, the biasing member 35 is not elastic but helps the engagement member 31 to go back to its original shape. The biasing member 35 helps the engagement members 31 to apply a horizontal force to the linear member 9. In some embodiments, a single biasing member 35 surrounds all the engagement members 31.

In some embodiments, the joint portions 32 can vary in thickness and or rigidity. In some embodiments, the joint portions 32 have the same thickness as the engagement members 31. In some embodiments, the joint portions 32 are integral with, thicker than, smaller than, made of the same material as, made of a differing material than, or a combination thereof, the engagement members 31. In some embodiments, one or more joint portions 32 and/or one or more engagement members 31 comprise a reinforcing material to assist in biasing the engagement members 31. The reinforcing material can comprise of metal, plastic, or other material. In some embodiments, the reinforcing material acts as a spring. In some embodiments, the joint portions 32 comprise of a metal leaf spring located inside and/or outside the material of the joint portion 32. In some embodiments, the engagement members 31 can comprise of a metal leaf spring located inside and/or outside the material of the engagement members 31.

As can be seen in FIG. 4*b*, in some of the embodiments, one or more of the engagement members 31 has a chamfered edge to allows for easier application of the cap 1.

Figure 5A:
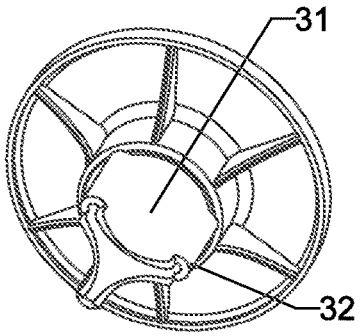
FIGS. 5A, 5B, and 5C show embodiments of a cap having differing numbers of engagement members and joints.
Figure 5B:
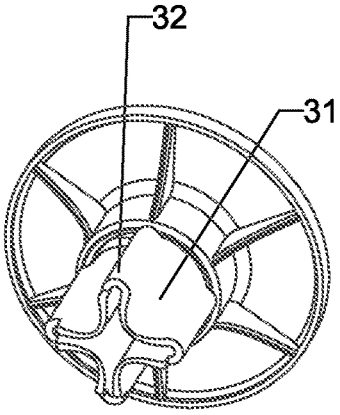
Figure 5C:
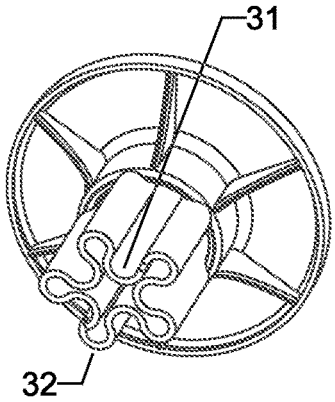

In FIGS. 5A-5C, embodiments of the cap 1 are shown. In some embodiments, there are three engagement members 31 and three joint portions 32. In some embodiments, there are four engagement members 31 and four joint portions 32. In some embodiments, there are five engagement members 31 and five joint portions 32. It is understood that any number of engagement members 31 and joint portions 32 greater than one can be selected. In some embodiments, the number of engagement members 31 is an odd number greater than, or equal to, three.

Any embodiment can have one or more of the engagement members 31 (and/or one or more of the joint portions 32) that are longer than other engagement members 31 to form the extension 33.

It is to be understood that some embodiments can comprise one or more of the following: engagement members 31, with or without biasing member 35; joint portions 32 without or without reinforcement; and different thicknesses of the joint portion 32.

Figure 6:
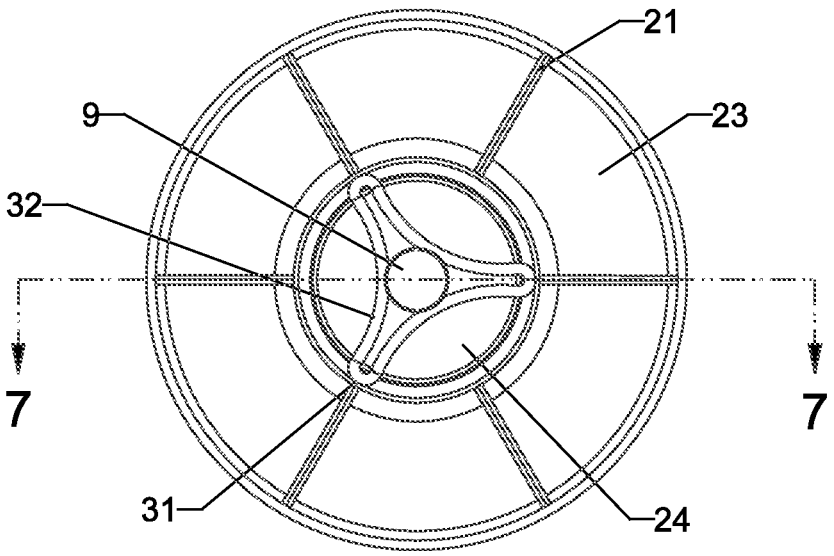
FIGS. 6 and 7 show an embodiment of a cap.
Figure 7:
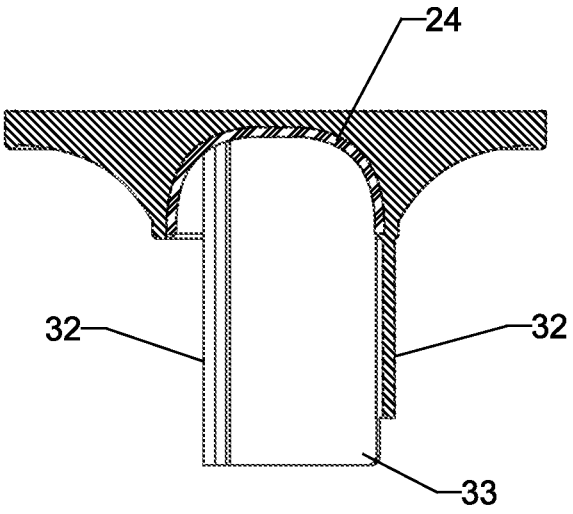
Figure 8:
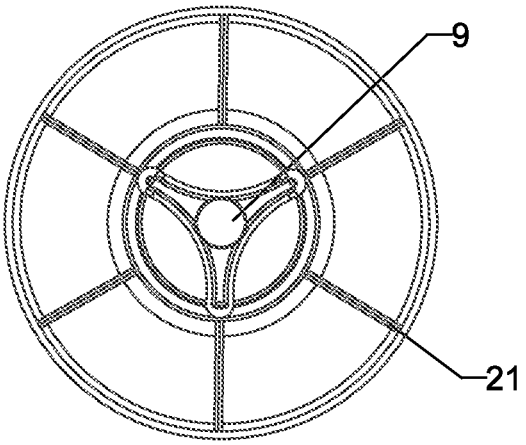
FIGS. 8 and 9 show an embodiment of a cap with a linear member of a lesser width.
Figure 9:
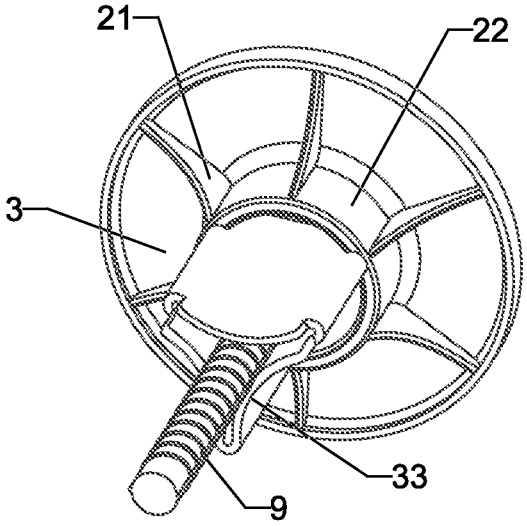
Figure 10:
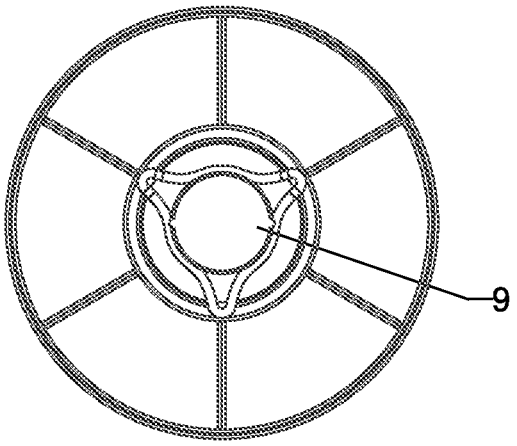
FIGS. 10 and 11, show the embodiment of the cap of FIGS. 8 and 9, with a linear member with greater width.
Figure 11:
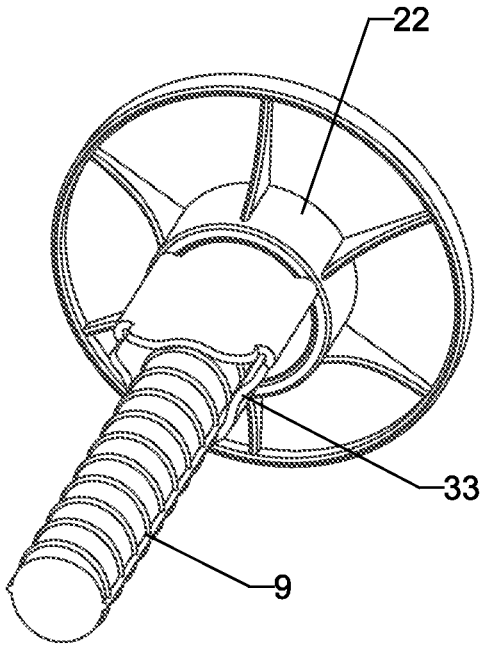

As seen in FIGS. 6 and 7, some embodiments of the cap 1 comprise a fortifying insert 24. The fortifying insert 24 can be located inside or outside the platform 2. In some embodiments, the fortifying insert 24 can be located inside or outside the support 22 and/or the attachment portion 3. In some embodiments, the fortifying insert 24 is made of metal. In some embodiments, the fortifying insert 24 is made of metal, plastic, ceramic, a composite, a woven material, or a combination thereof. The fortifying insert 24 can be designed to help prevent the linear member 9 from piercing the platform 2 during an event.

Also as can be seen in FIG. 7 (a cross-section of the embodiment of FIG. 6), in some embodiments, the engagement members 31 are free to move and toward platform 2, and the joint portions 32 are connected to the platform 2. This allows for lateral movement of the engagement members 31. In some embodiments, some or all of the engagement members 31 are coupled to the interior of the platform 2, resulting in some rotational movement. In some embodiments, the joint portions 32 are coupled to the platform 2, and the engagement members 31 are free. In some embodiments, one or more of the engagement members 31 are directly connected to the platform 2 and/or one or more of the joint portions 32 are connected to the platform 2.

As seen in FIGS. 8-11, in some embodiments, the same cap 1 is configured to accept linear members 9 of differing thicknesses. The range of sizes that the cap 1 is configured to accept can be predetermined as desired. In some embodiments, by changing the number of engagement members 31, the second sections 311, and/or the joint portions 32, the range in sizes of the linear member 9 that can be accepted can be altered. In some embodiments, changing the flexibility of the engagement members 31, the joints portions 32, the biasing members 35, or a combination thereof, can increase or decrease the range in sizes of linear members 9 that can be accommodated in a single cap 1. In use, a user would be able to take the cap 1, place it on a linear member 9 with a first width, remove the cap 1, and then place the cap 1 on a second linear member 9 having a second width.

Figure 12:
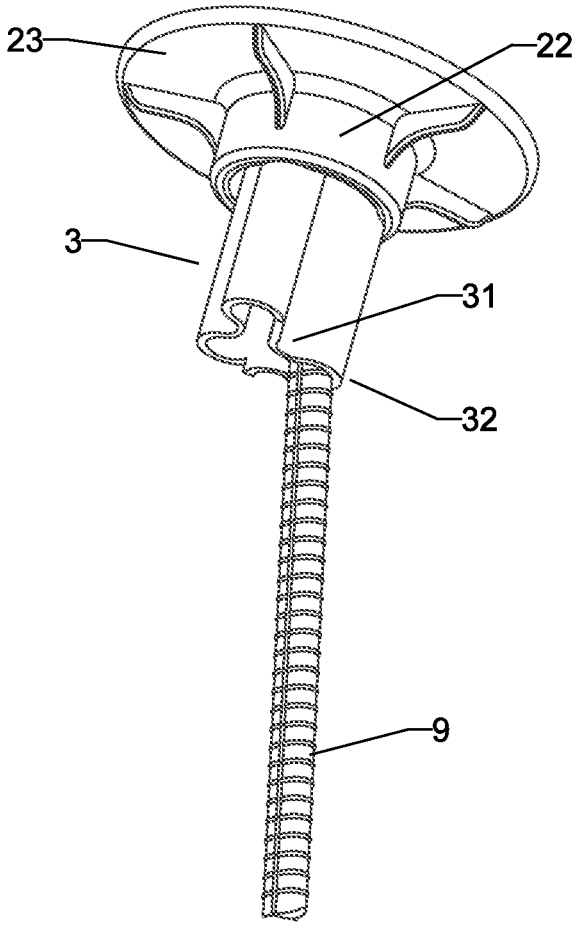
FIGS. 12 and 13 show an embodiment of the cap placed on a linear member in an off-center relationship.
Figure 13:
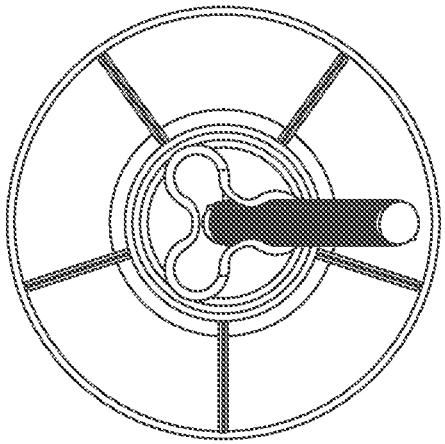
Figure 14:
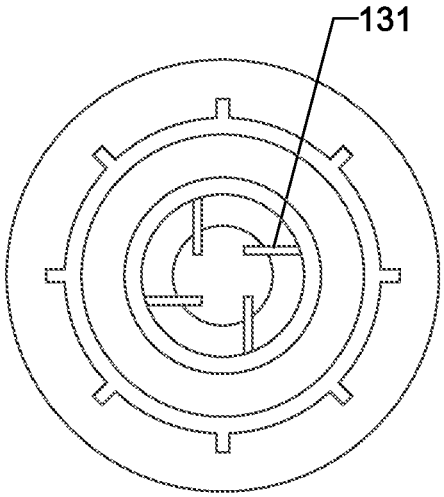
FIG. 14 (Prior Art)
FIG. 14 shows a cap according to the prior art.

Furthermore, as seen in FIGS. 12 and 13, even when the linear member 9 and the cap 1 are placed in an off-center relationship, the attachment portion 3 is able to secure the cap 1 to the linear member 9. In some embodiments, one or more engagement members 31 and/or one or more joints portions 32 are able to provide a biasing force against the linear member 9 so as to secure the cap 1 to the linear member 9. In some embodiments, at least a portion of the joint portion 32 at least partially surrounds a portion of the linear member 32. In some embodiments, at least a portion of an engagement member 31 at least partially surrounds a portion of the linear member 32.

It is understood that at times the cap 1 may be placed on a linear member 9 that fits freely within the engagement space 4 such that there may be some freedom of movement between the cap 1 and the linear member 9. However, the attachment portion 3, with the engagement members 4 will help keep the cap 1 centered on the linear member 9. Thus, when the cap 1 is bumped or slightly moved, one or more of the engagement members 4 will help to re-center the cap 1 on the linear member 9. Being bumped or slightly moved can also result in an off-center relationship as discussed above.

Some of the advantages of the cap 1 are, but not limited to, due to the design of the engagement members 31, when the cap 12 is placed on the linear member 9, it slides along the side of the engagement members 31. By sliding along the length of the engagement members 31, as opposed to colliding with the fins 131 of the prior art, the cap 1 is less likely to incur damage during use. When inserting rebar into the caps of the prior art as shown in FIG. 12, the rebar tends to improperly hit the sides internal projecting fins 131 (unless the cap 1 is placed on perfectly) resulting in plastically deformed fins 131. Further, the fins 131 are not well adapted to go from a larger diameter rebar to a smaller diameter rebar, because of the plastic deformation of the fins 131 that generally occurs. Thus, the fins 131 are not suitable for multiple uses given the damage caused by normal use and use on a number of different sizes of rebar present on a worksite. This deformation is a problem in the industry resulting in unsafe, possibly deadly, conditions.

Further, the fins 131 of the prior art are internal and not easily seen; thus, workers cannot see the damage to the fins 131 easily. In contrast, in some embodiments, the engagement members 31, and any damage thereto, are easily seen. Additionally, given that the engagement members 31, in some embodiments, apply a significant amount of force to the side of the linear member 9, they can also be applied to a linear member 9 that is extending in a horizontal direction.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

It should also be noted that elements of embodiments may be described in reference to the description of a particular embodiment; however, it is disclosed that elements of disclosed embodiments can be switched with corresponding elements of embodiments with the same name and/or number of other disclosed embodiments.

Depending on the embodiment, certain steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. An apparatus comprising:

a cap comprising a platform, and an attachment portion coupled to the platform;

wherein the attachment portion comprises:

two or more engagement members extending in a direction down from the platform and defining a substantially concave shape; wherein the two or more engagement members comprise a first engagement member; the first engagement member comprises a first engagement member first end, a first engagement member second end, and an engagement member body extending between the first engagement member first end and the first engagement member second end; and the two or more engagement members at least partially define an engagement space; and two or more joint portions; wherein the two or more joint portions comprise a first joint portion and a second joint portion; at least a portion of the first engagement member first end is coupled to, and configured to flex in relation to, the first joint portion, at least a portion of the first engagement member second end is coupled to, and configured to flex in relation to, the second joint portion;

wherein at least one of the two or more engagement members is configured to deflect and exert a securing force when a linear member is inserted inside the engagement space.

2. The apparatus of claim 1, wherein the engagement space is further at least partially defined by an inside of the two or more joint portions.

3. The apparatus of claim 1, wherein the platform further comprises a fortifying insert.

4. The apparatus of claim 1, wherein one or more of the two or more engagement members is longer than other of the two or more engagement members to define an extension.

5. The apparatus of claim 1, wherein the attachment portion is configured to secure a linear member, of a predetermined size, when the linear member abuts an inside of one of the two or more joint portions.

6. The apparatus of claim 1, wherein the platform further comprising one or more biasing members; wherein each biasing member biases one of the two or more engagement members inward.

7. The apparatus of claim 1, further comprising a linear member, wherein the linear member is located between the two or more engagement members and the two or more joint portions; and the linear member abuts the platform.

8. The apparatus of claim 3, further comprising a linear member, wherein the linear member is located between the two or more engagement members and the two or more joint portions; and the linear member abuts the fortifying insert.

9. The apparatus of claim 2, further comprising a linear member, wherein the linear member is located in the engagement space.

10. The apparatus of claim 2, wherein the engagement space is configured to individually accept linear members having differing widths or diameters.

11. The apparatus of claim 7, further comprising a linear member, and wherein the platform further comprising one or more biasing members; wherein each biasing member biases one of the two or more engagement members toward the linear member.

12. An apparatus comprising:

a linear member;

a cap comprising a platform, and an attachment portion coupled to the platform;

and the attachment portion comprises:

three or more engagement members extending in a direction down from the platform and defining a substantially concave shape; wherein the three or more engagement members comprise a first engagement member; the first engagement member comprises a first engagement member first end, a first engagement member second end, and an engagement member body extending between the first engagement member first end and the first engagement member second end; and three or more joint portions; wherein the three or more joint portions comprise a first joint portion and a second joint portion; at least a portion of the first engagement member first end is coupled to, and configured to flex in relation to, the first joint portion, at least a portion of the first engagement member second end is coupled to, and configured to flex in relation to, the second joint portion;

wherein the linear member is located inside the attachment portion; an inside of at least two engagement members, of the three or more engagement members, abut, deflect in response to, and apply a securing force to the linear member; and the platform is wider than the linear member.

13. The apparatus of claim 12, wherein the three or more engagement members define an engagement space, and the linear member is located in the engagement space.

14. The apparatus of claim 12, wherein the platform further comprises a fortifying insert, and the linear member is adjacent to or abuts the fortifying insert.

15. The apparatus of claim 12, wherein one or more of the three or more engagement members is longer than another of the three or more engagement members to define an extension.

16. The apparatus of claim 12, wherein each engagement member further comprises a first section and a second section, wherein the second section is substantially convex.

17. The apparatus of claim 16, wherein each second section is located in substantially a center of each engagement member.

18. The apparatus of claim 12, wherein the platform further comprising one or more biasing members; wherein each biasing member helps to bias one of the three or more engagement members inward against the linear member.

19. The apparatus of claim 13, further comprising a second linear member that has a width or diameter different from the linear member, and the engagement space is configured to secure, individually, both the linear member and the second linear member.

20. The apparatus of claim 12, wherein the linear member abuts an inside of one of the three or more joint portions.

* * * * *